United States Patent [19]

Etienne et al.

[11] Patent Number: 4,632,172

[45] Date of Patent: Dec. 30, 1986

[54] CENTRIFUGAL PIPE CASTING WITH PROGRESSIVELY INCLINED AND RAISED POUR CHANNEL

[75] Inventors: Bernard Etienne, Pont a Mousson; Michel François, Nancy; Michel Pierrel, Pont a Mousson, all of France

[73] Assignee: Pont-a-Mousson S.A., Nancy, France

[21] Appl. No.: 712,508

[22] Filed: Mar. 13, 1985

[30] Foreign Application Priority Data

Mar. 16, 1984 [FR] France ..... 84 04249

[51] Int. Cl.[4] ..... B22D 13/02; B22D 13/12

[52] U.S. Cl. ..... 164/301; 164/114; 164/155; 164/299

[58] Field of Search ..... 164/114, 117, 136, 286, 164/299, 300, 301, 335, 4.1, 150, 154, 155, 457; 222/606, 607

[56] References Cited

U.S. PATENT DOCUMENTS 4,316,495 2/1982 Pierrel ..... 164/117

FOREIGN PATENT DOCUMENTS 430464 2/1948 Italy .

54-1232 1/1979 Japan ..... 164/301

*Primary Examiner*—Nicholas P. Godici

*Assistant Examiner*—Richard K. Seidel

*Attorney, Agent, or Firm*—Sughrue, Mion, Zinn, Macpeak and Seas

[57] ABSTRACT

In the centrifugal casting of iron pipes, molten metal from a tilt ladle 13 is supplied to an inclined pour trough or channel 14 whose outlet nose 16 is relatively axially movable within a rotating mold 3. To compensate for the reduction in the hydrostatic thrust of the molten metal in the pour channel when the metal supply is terminated near the end of the casting operation, the inclination of the channel 14 is gradually increased to thereby maintain a constant flow rate at the nose 16. Further, to compensate for the reduction of the height of fall due to the tilting of the pour channel and the attendant lowering of the downwardly sloping nose, the point of articulation 22 of the channel 14 within the mold is also raised in synchronism with the increased tilting of the channel.

7 Claims, 15 Drawing Figures

CENTRIFUGAL PIPE CASTING WITH PROGRESSIVELY INCLINED AND RAISED POUR CHANNEL

BACKGROUND OF THE INVENTION

This invention relates to the centrifugal casting of iron pipes. More specifically, it concerns the De Lavaud casting process in which (i) molten iron is poured into a revolving mold through a pour channel fed by a casting ladle, (ii) a relative longitudinal motion is produced between the channel and the mold, and (iii) the supply of molten iron in the channel is cut off before the casting nose reaches the end of the mold.

As is well known in the art, the pour channel is shaped like a gutter extended at the upstream end by a widened spillway gate into which the ladle pours the molten iron. The channel may be of a single piece or may be constructed of several sections reinforced by a support cradle. The mold generally has a socket end and a plain end, the latter being closest to the channel.

Italian patent No. 430,464 describes an apparatus for centrifuging metal pipes in which it is possible to manually adjust the slope and height of the casting channel prior to casting. These are set before undertaking a series of castings, and during each casting the slope and height of the casting channel are fixed and do not vary. Such apparatus enables adaptation to the various types of pipe manufactured, but does not allow for the correction of the flow speed when the supply of liquid metal is cut off. Nor does it ensure that the channel will be completely empty at the end of the casting.

In order to hold constant the flow of molten iron entering the mold, conventional processes alter the speed of relative axial translation between the mold and the channel, which involves a complicated control arrangement. Furthermore, near the end of the casting and after the supply to the channel has been interrupted, this speed of translation must be reduced, presenting the drawback of prolonging the length of the pipe manufacturing cycle.

Similarly, varying the flow of metal poured into the mold by changing the tilting speed of the ladle, or, more generally, the rate at which the channel is supplied, involves relatively tricky and complicated controls whose effect is delayed by the great length of the pour channel.

In addition, in the two preceding cases, a residual amount of molten iron remains in the channel at the end of the casting and hardens there in the form of an iron tab, which must be removed before the next casting.

In order to cure these drawbacks the assignee previously developed, as described in French patent No. 2,459,698, an apparatus which enables a simple and precise modulation of the flow of iron into the mold by varying the angle of inclination of the pour channel. According to the '698 patent after the supply of molten iron is interrupted the slope of the channel is gradually increased so as to keep the flow of iron constant until the casting nose exits the mold. This makes it possible to empty the channel nearly completely with each casting, which almost totally eliminates the drawbacks due to the residual iron mentioned above. This process thus makes it possible to obtain cast pipes of essentially uniform thickness without altering the relative speed of translation or the rate at which molten iron is supplied to the pour channel. To carry out this function, the '698 patent uses a nearly horizontal, cantilevered beam or cradle on which a channel for bringing liquid metal into the revolving mold is pivoted, with the point of articulation of the channel being located near the casting nose. A piston and cylinder unit placed below the beam on the opposite end from the casting nose (in the vicinity of the spillway) makes it possible to tilt the channel toward the revolving mold in the final phase of pipe casting in order to allow the residual quantity of molten iron in the channel to flow completely into the mold, while simultaneously maintaining optimal flow conditions.

Although the improvements realized by the '698 patent are satisfactory, several drawbacks still exist. For example, as the channel slopes toward the mold, which is simultaneously being driven in rotation and in longitudinal translation, the end of the casting nose approaches the lower generatrix or bottom of the mold because it is cantilevered from the channel's point of articulation. The cantilevering cannot be avoided because of the unacceptable overheating to which the channel journals would be subjected if they were installed at the very end of the casting nose. The result of this movement is a variable height of fall for the molten iron, which interferes with the distribution of the iron emptied into the revolving mold. The uniform spreading of the iron thus decreases as the casting nose approaches the inner wall of the mold, leading to the formation of pipes having a slightly wavy inner surface. The waves become more pronounced as the height of fall of the molten iron is reduced.

At first glance it may seem sufficient to increase the initial height of the casting nose to cure the above-mentioned drawback. However, it is also well known that in a pipe centrifuger the mold, or its protective inner coating, erodes more quickly the higher the height of fall of the molten iron. Such erosion constitutes a considerable drawback by reason of the higher manufacturing cost it entails.

SUMMARY OF THE INVENTION

The assignee has attendantly perfected and improved the apparatus of the '698 patent to eliminate the two above-mentioned snags, that of a centrifuged pipe having a wavy inner surface at the plain end, and that of the erosion of the mold lining.

The present invention thus provides a process for supplying liquid metal to pipe centrifuging machines of the type having an inclinable pour channel supported by a cradle, in which, as the channel is inclined at the end of the casting operation, the nose of the channel is kept at a constant height above the lower surface of the mold cavity, regardless of the degree of slope of the channel, by raising the axis of articulation of the channel as the latter is raised to thereby compensate for the lowering of the casting nose by raising the point of articulation of the channel.

The apparatus of the invention comprises a carriage for moving the pour channel along the casting mold and a cradle that considerably overhangs the carriage. The cradle carries a channel support of a length approximately equal to the cradle, and the channel support is pivoted to the cradle near its nose to allow it to slope under the effect of an associated piston and cylinder unit. The cradle is mounted like a balance beam resting indirectly on the carriage through a horizontal articulation at the upstream end and through height supports that can be adjusted during the casting process.

With this arrangement the lowering of the pour channel's nose that would normally occur when the upstream end of the channel was raised (in the course of its increased tilt at the end of the casting operation) is compensated for, or neutralized, by raising the casting nose by the same height by lifting the axis of articulation of the pour channel support or its cradle by an appropriate value. In this way, one maintains a constant height of the casting nose as the channel is tilted.

DETAILED DESCRIPTION OF THE PREFERRED EMBODIMENTS

Figure 1:
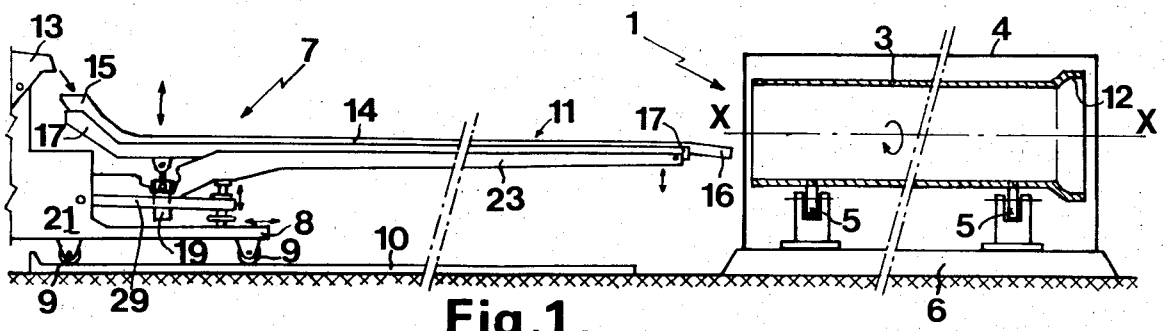
FIG. 1 is a schematic elevation, in cross-section and partially cut away, of a centrifugal casting machine comprising an apparatus for supplying molten iron according to the invention.
Figure 2:
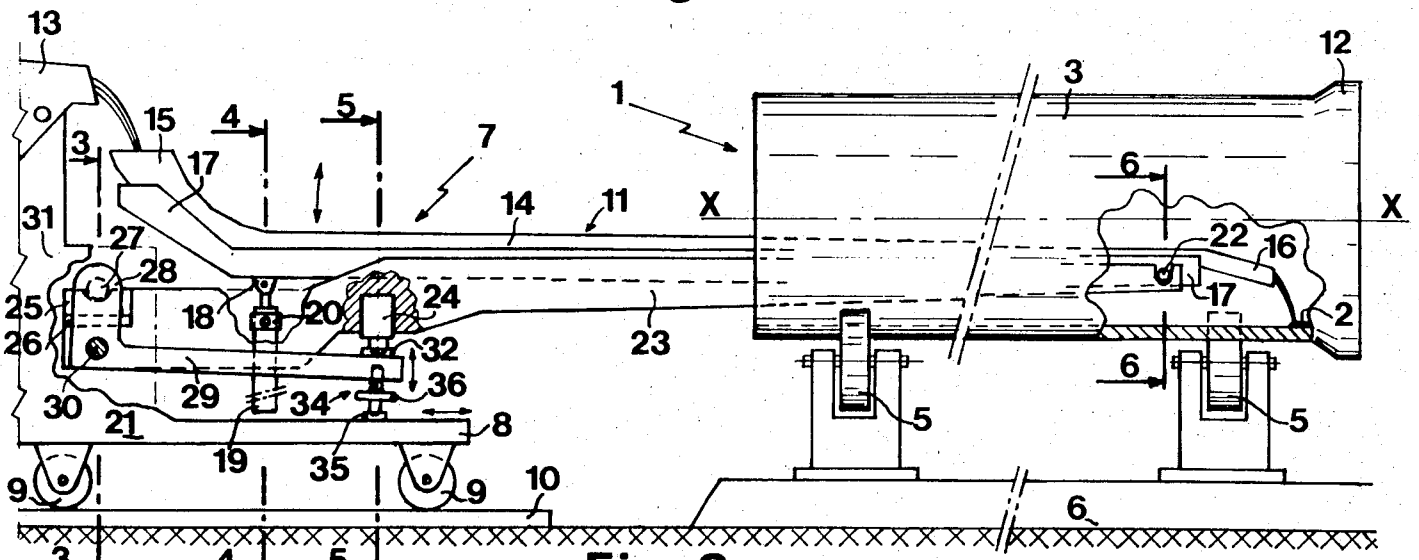
FIG. 2 is an analogous but larger scale schematic view of the casting apparatus of this unit.

In the embodiment of FIGS. 1 and 2 the invention is applied to a machine 1 for centrifuging large socketed pipes 2, which may be between 700 and 1200 mm in diameter. The machine essentially comprises a centrifugation mold 3 having a horizontal axis X—X and revolving within a housing 4 by means of rollers 5 supported on a base 6, with one or more of the rollers 5 being motorized. The mold 3 is supplied with molten iron by casting means 7 composed of a carriage 8 that moves in translation on wheels 9 which travel along tracks 10 parallel to axis X—X so that channel unit/cradle assembly 11 may be inserted into mold 3 up to its furthest end, which has a socket 12. Casting means 7 (FIGS. 1 through 6) is supplied with molten iron by a tilting casting ladle 13 that is represented in part by its pour spout.

To facilitate the description, all elements on the casting ladle side will be described as lying "upstream", and all elements near the centrifugation machine as lying "downstream".

The cradle assembly 11 is composed of a pour channel 14 inclined downwardly toward mold 3 with a slope of approximately one degree at rest. The channel is provided with a spillway 15 upstream, and with a casting nose 16 downstream having a greater slope (about +10 degrees) than that of the channel itself. The rectilinear portion of the channel 14 between spillway 15 and nose 16 is held up by a channel support 17 in the shape of a chute with a cross-section matched to that of channel 14.

In the vicinity of spillway 15, the lower portion of channel support 17 is provided with a bearing 18 (FIGS. 1, 2, 4, 8) that forms a joint with the head of the piston rod of a cylinder 19 used to tilt the channel at the end of the pipe casting process. The body of cylinder 19 is journaled to a bearing 20 integral with a cradle 23 that carries support 17. Close to the downstream end of the channel, the upper portion of channel support 17 is flanked by two journals 22 (detail in FIGS. 6–9) having axes Y—Y orthogonal to axis X—X and resting in two U-shaped notches or half-bearings open at the top, formed near the downstream end of cradle 23. The cradle is an essentially horizontal beam that is hollow over approximately 4/5 of its length so as to be able to contain and fit together with the matching rounded lower contour of channel support 17.

In the '698 patent mentioned above, the upstream end of the cradle or hollow beam that is here designated 23 is fastened in an integral and cantilevered way to the frame of carriage 8, which carries it. In the present invention (FIGS. 1–5, 7, 8, 13 and 14), cradle 23 is still cantilevered with respect to carriage 8, but it is no longer fastened to it. Cradle 23 rests indirectly upon carriage 8 in the manner of a balance beam. It is cantilevered over the adjustable height support which consists of two lateral piston and cylinder units 24 whose bodies, located on either side of cradle 23, are integral with the latter and housed in its lower portion at a distance from its upstream end of about one fifth of its total length. Close to the edge of the upstream end (FIGS. 2–3), the upper part of cradle 23 is provided with a half-bearing 25 that is open upwardly and which can be raised by a spacer block 26. Half-bearing 25 rests against a horizontal journal 27 (with axis Z—Z orthogonal to axis X—X) that is fastened perpendicular to two side plates 28 placed symmetrically on either side of cradle 23. The plates 28 are integral with an intermediate frame 29 between carriage 8 and cradle 23. Each plate 28 forms a bent lever with frame 29. By means of two horizontal journals 30 (having axis W—W parallel to axis Z—Z and orthogonal to axis X—X) that are integral with it, and which are located below journal 27, intermediate frame 29, which extends parallel to cradle assembly 11 on either side thereof and above carriage 8, is articulated in two bearings that are integral with two lateral uprights 31 and parallel with a chassis 21 borne by carriage 8. Downstream, intermediate frame 29 is positioned between piston cylinders 24 of cradle 23 and adjustable jacks 34 on carriage 8. On the upper surface of intermediate frame 29, which, from above, is shaped like a stirrup open in the upstream direction, are two support plates 32 with a concave spherical impression. These plates 32 match the contour of the ends of piston rods 33 of the cylinders 24, for which they serve as supports.

The initial positioning of pour channel 14, and more specifically the height of the end of casting nose 16 with respect to the inner and lower surface of mold 3, is adjusted with screw jacks 34 that remain set during the casting process. These are located opposite each support plate 32, between the lower part of intermediate frame 29 and the upper part of chassis 21 of carriage 8, with one end of each jack screw engaging threads machined in intermediate frame 29 while the other end, which is cylindrical and smooth, rests in a spherical impression 35 on the upper part of chassis 21. Each jack is controlled by an integral hand wheel 36. Jacks 34 support intermediate frame 29 on carriage 8 at a setting that remains fixed during the casting process. Given the great force that must be imparted to wheels 36 to raise the mass of cradle assembly 11, its operation may be facilitated through the use of a jack 38 inserted between the upper part of chassis 21 and the lower part of intermediate frame 29. Jack 38 raises frame 29 during the manipulation of wheels 36.

As can be seen, cradle 23 is therefore not rigidly affixed to carriage 8 but rather is mounted on it like a balance beam, resting on the carriage by means of side plates 28 and frame 29, which is pivoted and can be adjusted in height over carriage 8. Above frame 29, cradle 23 is articulated by half-bearing 25 and journal 27 in side plates 28, and rests on frame 29 through support cylinders 24. Cradle 23 is thus a beam capable of being tilted between one position shown in broken lines and another shown in solid lines (FIGS. 7 and 8), depending on the stroke of pistons 24 during casting, by half-bearing 25 pushing against journal 27.

Figure 15:
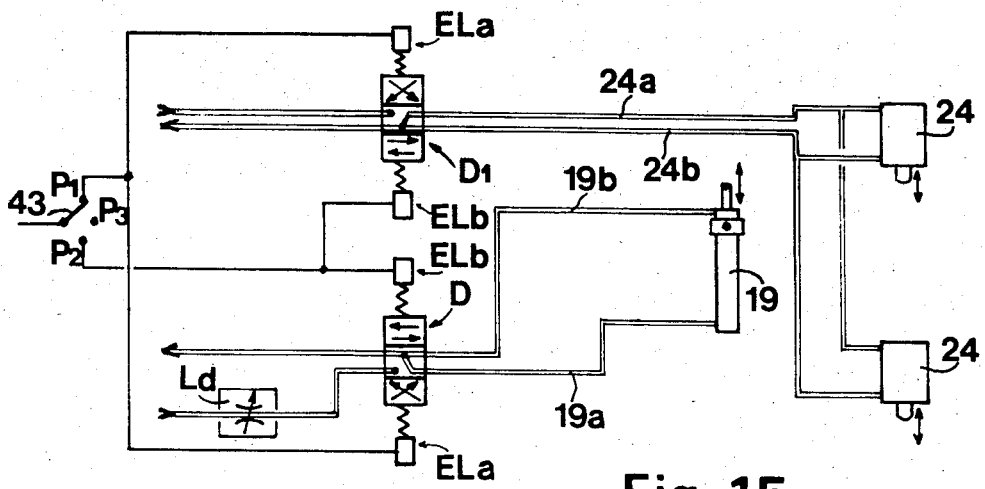
FIG. 15 is a schematic diagram of the hydraulic controls for synchronizing the piston used to lift the casting channel and those used for raising it at its point of articulation.

Referring now to FIG. 15, the control circuits for cylinders 19 and 24 are supplied through a common hydraulic unit (not shown). Hydraulic fluid is selectively supplied to either side of the piston of cylinder 19 by a slide valve D, and to either side of the pistons of cylinders 24, which are connected in parallel, by a slide valve D1. Valve D is connected to the base of cylinder 19 through a supply circuit **19*a* used to control the angle of incline of the assembly made up of channel 14 and channel support 17, and to the upper part of cylinder 19 through a discharge circuit 19*b* that returns the hydraulic fluid to the hydraulic unit and, consequently, returns the assembly of channel 14 and channel support 17** to its initial position.

Valve D1 is connected to the upper end of cylinders 24 through a common supply circuit **24*a* for raising channel nose 16 and keeping it at a constant height, and to the lower part of cylinders 24 through a discharge circuit 24*b* for returning the fluid to the hydraulic unit and, consequently, for returning the pistons of cylinders 24** to their initial position.

The synchronization of the movements of the pistons of cylinders 19 and 24 can be adjusted by a flow limiter Ld with an adjustable loss of pressure that makes it possible to synchronize the raising speed of the assembly of channel 14 and channel support 17 with that of channel nose 16, and thus to compensate for the lowering of casting nose 16 (as channel 14 rises) through the raising of articulation 22.

The position of the slides of valves D and D1 is controlled by electromagnets ELa and ELb which are integrally installed on each of the ends of the slides and are excitable in pairs by a three-way switch 43. One position P1 excites electromagnets ELa in parallel in order to supply circuits **19*a* and 24*a*, a second position P2 excites electromagnets ELb in parallel in order to supply circuits 19*b* and 24*b*, and a third neutral position P3 places supply circuits 19*a* and 24*a* into communication with the respective discharge circuits 19*b* and 24*b* in order to block the pistons of cylinders 19 and 24** in place.

OPERATION

According to the embodiment illustrated in FIGS. 1, 2, 7, 11 and 12, with casting channel 14 and its support 17 resting on cradle 23, the height h1 of the end of casting nose 16 is first adjusted with respect to the lower generatrix of mold 3 using screw jacks 34 alone if the mold has a diameter of between 700 and 900 mm. This is a fixed adjustment, only done prior to casting.

Figure 10:
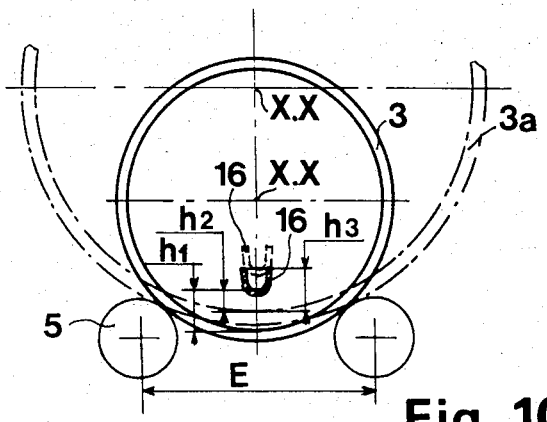
FIG. 10 is a schematic end view of a casting channel nose inside a revolving mold, showing the need to adjust the initial height of the nose when the diameter of the mold is changed.

In the case of a mold **3*a* (FIG. 10) having a diameter greater than 900 mm, the setting of screw jacks 34 is preceded by the elimination of spacer block 26 and the insertion of blocks 37 (FIG. 11) between support plates 32 and the upper surface of intermediate frame 29**.

The pipe casting cycle is begun with casting means 7 mounted on carriage 8 and set back as far as possible from mold 3 (FIG. 1). Mold 3 is set into rotation about its axis X—X while carriage 8 traveling on tracks 10 advances toward centrifuging machine 1. Casting channel 14, with its support 17 resting on the bottom of cradle 23, then enters mold 3, and a flow of molten iron is released by causing ladle 13 to tip forward into spillway 15 of the channel at a given moment, such that the molten iron reaches casting nose 16 just when the latter arrives at socket 12 of mold 3.

Figure 8:
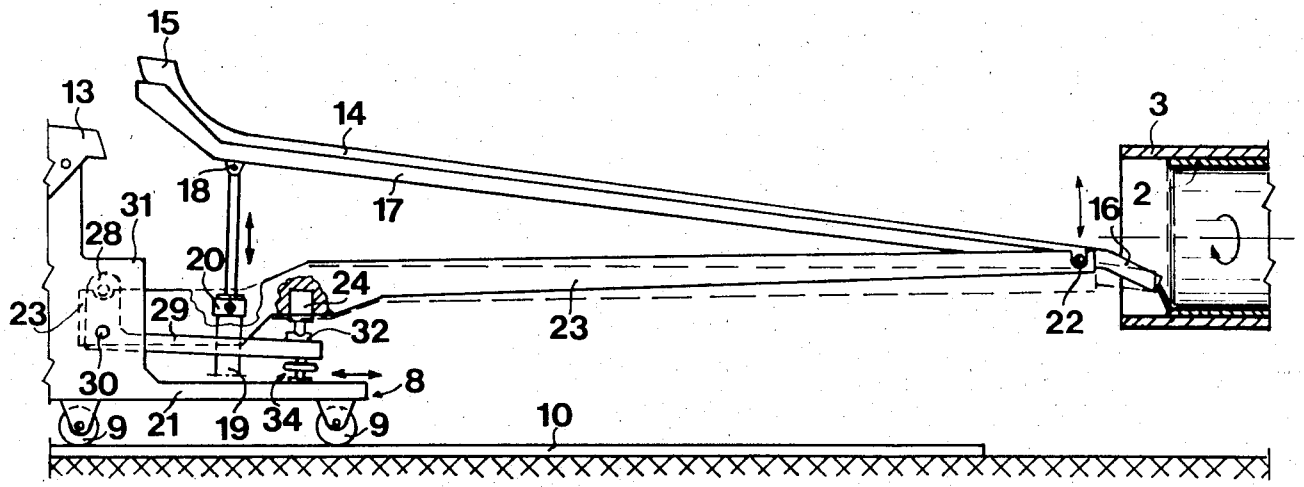
FIG. 8 is a view corresponding to FIG. 7 representing the channel of the invention in an inclined position.

Once the socket is filled with iron, casting means 7 mounted on carriage 8 backs up, continuing to pour iron all along the cylindrical barrel of mold 3. It is at the moment casting nose 16 approaches the final extremity of mold 3 that, in quasi-simultaneous fashion, the supply of iron is cut off by raising the pour spout of ladle 13, and the inclination of channel 14 is begun (FIG. 8). This is done by activating cylinder 19 and raising casting nose 16 in synchronization. The latter two operations are triggered by an automatic, preset actuation of switch 43 in position P1, which has the effect of exciting in parallel the electromagnet ELa of each valve D and D1, simultaneously pressurizing supply circuits **19*a* and 24*a* of cylinders 19 and 24. While support 17 of casting channel 14 tilts in cradle 23 on journals 22, "compensation" cylinders 24 lift cradle 23 above intermediate frame 29 in synchronization with cylinder 19. With the upper part of its other end, cradle 23 presses against journal 27 borne by intermediate frame 29**.

Figure 9:
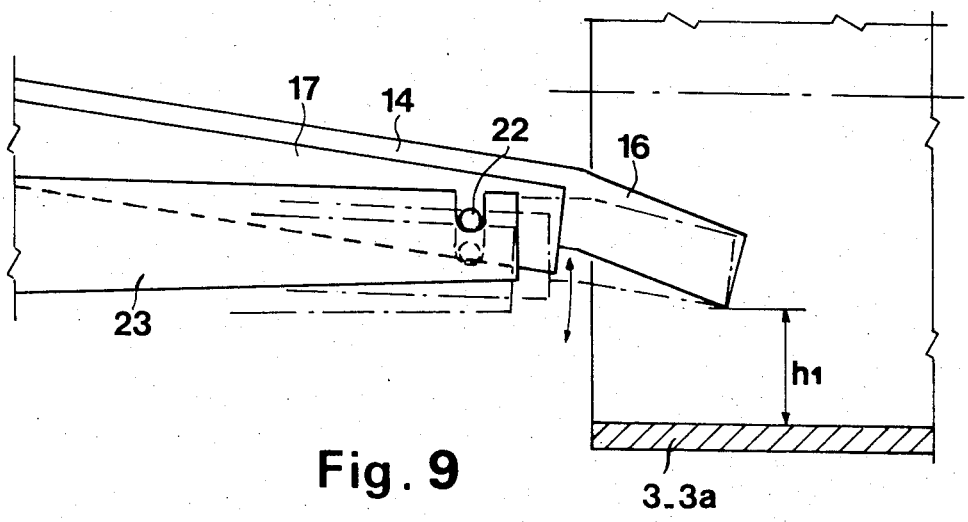
FIG. 9 is an enlarged partial view of the casting channel nose in the inclined position of FIG. 8.
Figure 7:
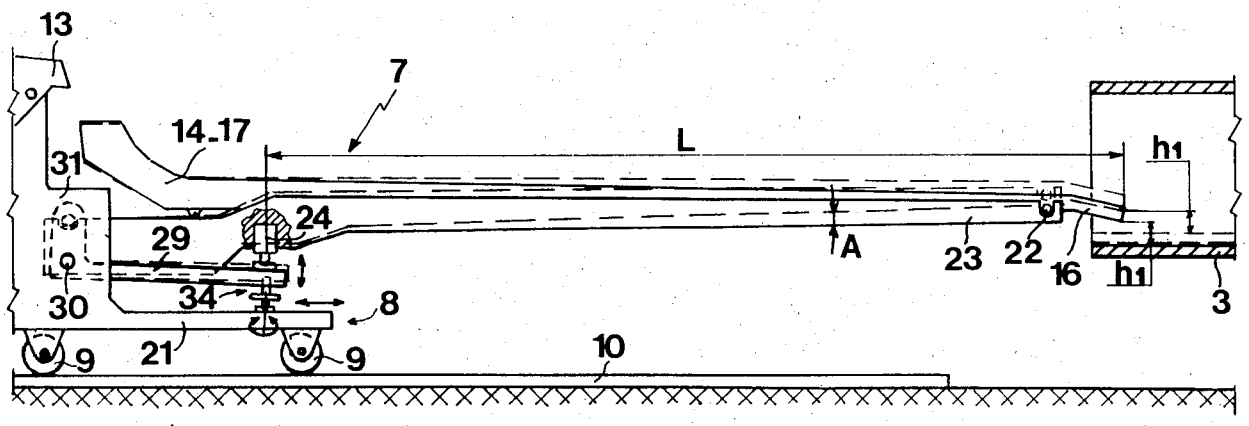
FIG. 7 is a simplified schematic elevation of the apparatus, larger in scale than FIG. 1, illustrating an initial height setting of the casting channel at the plain end of the mold.

Consecutively, axis Y—Y of journals 22, used to tip support 17 of casting channel 14, moves upwards in the direction of the arrows indicated in FIGS. 8 and 9, describing a slight circular arc 15 about axis Z—Z. This brings about the automatic correction and maintenance of height h1 of the end at the casting nose, as the latter tends to move closer to the lower generatrix of mold 3 due to the change in the slope of channel 14 with its overhang situated downstream from journals 22.

Of course, this automatic maintenance of casting nose 16 at height h1 might have been avoided if it had been possible to move the articulation axis Y—Y of channel support 17 as close as possible to the end of casting nose 16. Unfortunately, this is not possible because of the accentuated slope of the casting nose vis-a-vis the rest of pour channel 14, such difference in slope being required by the sum of the superimposed, paired thicknesses of channel support 17 and cradle 23, which result in an excess elevation of channel 14 above the lower generatrix of mold 3, an excess that must be compensated for. This excess elevation already exceeds the acceptable height (about 100 mm) from which molten iron can be dropped into casting molds 3. The considerable thickness of cradle 23 cannot be reduced except at the expense of its strength. Nor can the length of the overhang from nose 16 downstream to the fulcrum represented by the spherical impressions of support plates 32 be reduced. Such length must be sufficient to accommodate the length of the mold 3. Furthermore, journals 22 could not withstand the intensive heat of the molten iron if they were placed closer to the end of casting nose 16.

After channel 14 reaches a maximum preset height, switch 43 is placed in position P2 to allow valves D and D1 to momentarily communicate supply circuits 19*a* and 24*a* with their respective discharge circuits 19*b* and 24*b*. This maintains the casting channel and its nose in the optimal height position temporarily, until channel 14 is completely empty. Known anti-return devices (not shown) are placed in circuits 19*a*, 19*b*, 24*a*, and 24*b* to prevent any untimely movement of the cylinders during this time.

When channel 14 is totally empty, and thus when the casting of the pipe has been completed, switch 43 is placed in position P3 to trigger consecutively the excitation of the electromagnets ELb of valves D and D1, the discharge of circuits 19*b* and 24*b* back to the hydraulic unit, and the return of cylinders 19 and 24 to their initial position, which implies as a consequence the return to the initial low position of assembly 11 and cradle 23. During this time casting means 7 continues to move backwards on carriage 8, away from mold 3.

When the cast pipe has hardened, it is removed. The unit is then ready for a new casting.

If the conditions of manufacture require, for example, a frequent change of very close mold diameters, it would be relatively easy, in order to limit the time needed for the initial adjustment of casting means 7 in the course of substituting molds 3, to automate the initial adjustment mechanisms. Thus, hydraulic cylinders could be substituted for the manually controlled screw jacks 34 and for spacer blocks 26 and 37. Similarly, the limits of the initial height settings h1 of the pour channel nose could be extended, or reduced, depending on the larger or smaller diameters of the molds 3, 3*a* being used.

Figure 11:
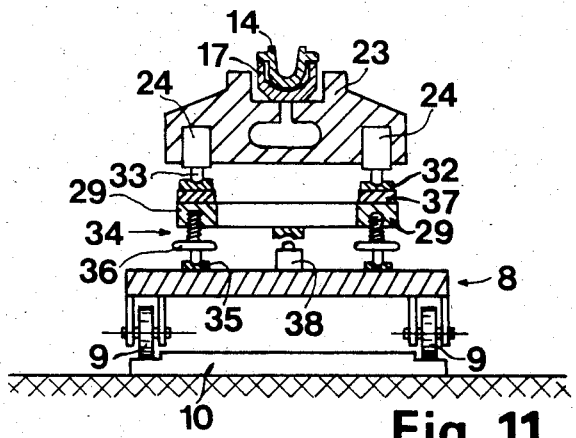
FIG. 11 is a cross-sectional view analogous to FIG. 5 but with a block for adapting the initial height of the casting nose.
Figure 12:
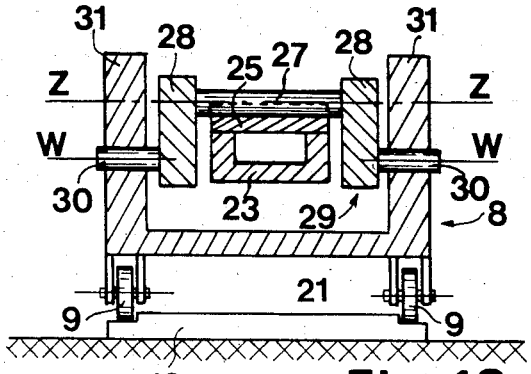
FIG. 12 is a cross-sectional view analogous to FIG. 3 but without the adapter block for the initial height of the casting nose.
Figure 13:
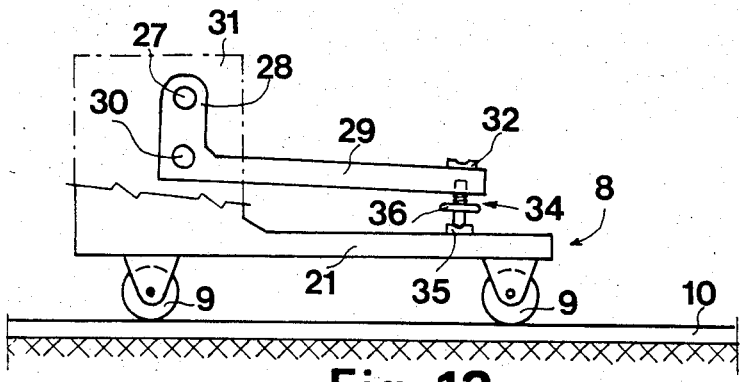
FIG. 13 is a schematic elevation of the channel cradle support carriage.
Figure 14:
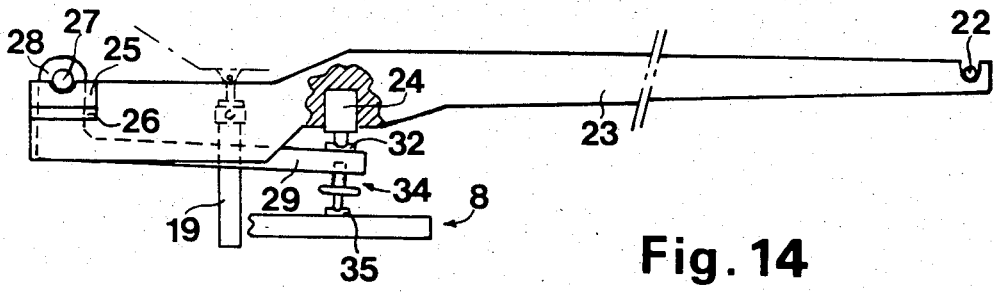
FIG. 14 is a schematic elevation of the channel support cradle.

As an alternative and as briefly mentioned above, depending on the diameter of mold 3 or 3*a*, blocks for adjusting the height of cradle 23 may be used at the cradle's two supports on intermediate frame 29. Thus, for diameters between 700 and 900 mm (mold 3), the upstream support of cradle 23 on journal 27 is lowered (FIG. 3) by inserting a spacer block 26 between cradle 23 and half-bearing 25. For diameters greater than 900 mm the downstream support of cradle 23 on plates 32 may be raised by inserting spacer blocks 37 between plates 32 and intermediate frame 29, eliminating block 26 (FIG. 11). Using screw jacks 34, it is thus possible to adapt the initial height h1 of the end of casting nose 16 vis-a-vis the level of the lower generatrix of mold 3 by varying by several fractions of a degree, and without reversing the direction of flow, the original slope of cradle 23, support 17, and channel 14, which is on the order of one degree. This very slight angular variation A has purposely been exaggerated in FIG. 7 to facilitate comprehension. This Figure also reveals the reasons for which it is not necessary to excessively vary the slope of channel 14, or angle A, in order to obtain the result sought, which is symbolized by the designation h1 in FIG. 7, by way of example. This is so because of the high amplification ratio tied to the great length L of channel 14, as measured between casting nose 16 and the fulcrum represented by cylinders 24 and the spherical impressions in plates 32. Length L may reach seven meters or more.

The initial height setting h1 of the casting nose is required not only before the beginning of a series of castings, but above all with any substitution of molds of different diameters. As was already explained in summary fashion above, mold 3 rests on a set of bearing rollers 5 on which it rotates. As is shown schematically in FIG. 10 in solid lines, the height of these rollers is constant, as is the distance E between their centers. Mold 3 rests upon rollers 5, while the end of casting nose 16 occupies a position of initial height h1 with respect to the lower generatrix of mold 3. If mold 3 is replaced with mold 3*a* (broken line) having a larger diameter than mold 3, it will be observed that the lower generatrix of this new mold 3*a* is much closer to casting nose 16 than in the preceding case. The new position of nose 16 with regard to mold 3*a* is at a height h2 that is inconsistent with optimal casting conditions. It is thus necessary to raise the casting nose until a height h3 is reached, corresponding to h1 in the preceding case and thus meeting the optimal flow conditions for the iron prior to the automatic tilting of the channel at the end of the casting operation.

In reality, the variations in casting nose height h1, h2, and h3 involved in changing mold diameters within a certain range are relatively small. For example, in the case in which a 900 mm mold is replaced with one having a diameter of 700 mm, the height differences that must be corrected are on the order of 170 mm for an angular change A of one degree. The stroke of the screw jacks 34 that accomplish this correction was purposely reserved for purposes of making corrections within the aforementioned range.

Figure 3:
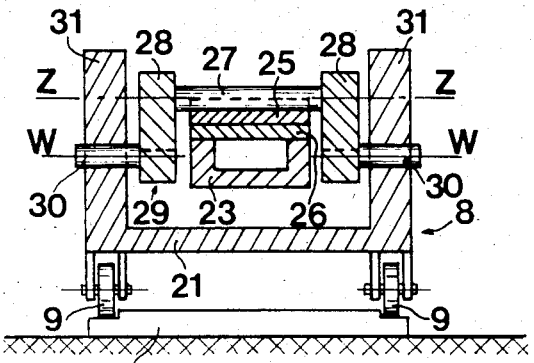
FIGS. 3, 4, 5 and 6 are large-scale transverse sections along lines 3—3, 4—4, 5—5, and 6—6 of FIG. 2, with FIG. 6 being more enlarged than FIGS. 3, 4 and 5.
Figure 4:
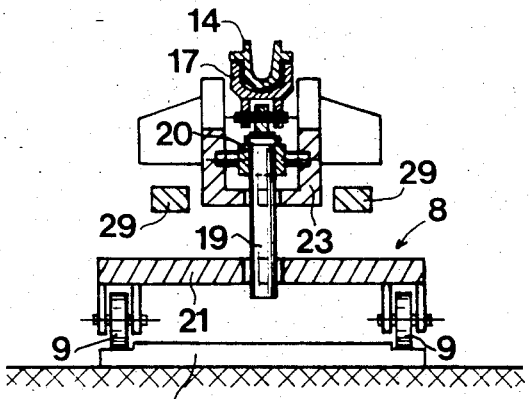
Figure 5:
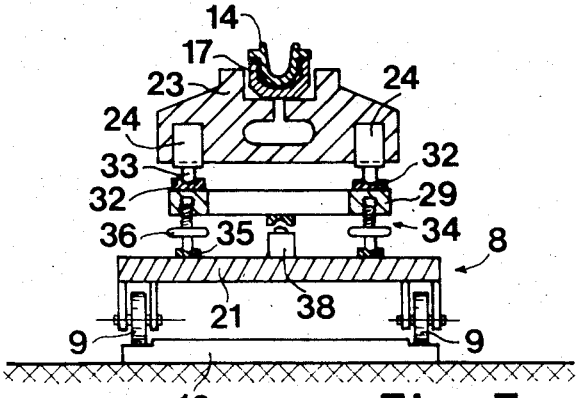
Figure 6:
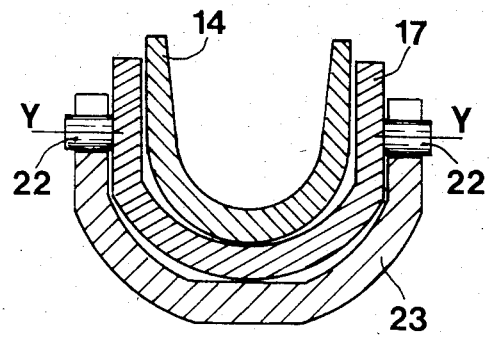

The same is not true when one wishes to place molds having a diameter of between 1000 and 1200 mm on the same set of rollers 5. Such diameters can be accommodated by the same pipe centrifuging machines and used with the casting means of the invention. However, it will be observed that in order to maintain an acceptable casting nose height under these conditions, it would be necessary to change the slope of the channel drastically, thus changing angle A by a value that exceeds the permitted tolerances and arriving at an inversion of the slope of channel 14 (slope rising toward mold 3), for a negative direction of flow. To remove this drawback, and to compensate for the purposely limited adjustment possibilities of screw jacks 34, the variant of FIG. 11 provides for supplementing the action of the latter through the insertion of spacer blocks 37 between the plates 32 and the upper surface of intermediate frame 29. The spacer block 26 lying between half-bearing 25 and the upper part of cradle 23 in FIG. 3 is then removed in order to bring the excessive slope of channel 14, resulting from the above addition of spacer blocks 37, back to a position of optimal flow, i.e., a negative slope of one degree toward the centrifuging machine, with the final adjustment of height h1 being performed by means of screw jacks 34.

In the two preceding cases, i.e. molds having diameters of between 700 and 900 mm, and molds between 900 and 1200 mm, the stroke of screw jacks 34 would be in a middle setting for an average mold diameter within each of the two diametrical ranges. This enables adjustments in the slope of channel 14 about an average, optimal value for the flow conditions of the iron during casting, without ever leaving the range of permissible tolerances in the slope of channel 14.

Finally, by virtue of the insertion of intermediate frame 29 with its side plates 28 between cradle 23 and carriage 8, it is possible to tune the fixed slope settings of cradle 23 prior to casting as set forth above.

What is claimed is:

1. An apparatus for supplying liquid metal to a pipe centrifuging machine of the type having a revolving centrifugation mold (3), an elongate inclinable pour channel (14) having a spillway (15) at one end and a casting nose (16) at another, opposite end, a carriage (8) for moving the pour channel in axial translation relative to the mold, an elongate support cradle (23) heavily cantilevered with respect to the carriage, the cradle being articulated at one end to the pour channel proximate said opposite end thereof but displaced upstream from an outlet end of the casting nose, and a fluid cylinder (19) mounted to the support cradle proximate the spillway for inclining the channel upon terminating a delivery of liquid metal into the spillway, characterized by: means for mounting the cradle on the carriage in the manner of a balance beam, said mounting means including a horizontal journal (27) disposed in an upstream direction of the carriage, and adjustable fluid cylinder means (24) spaced downstream from said journal for raising an axis of articulation (22) between the pour channel and the support cradle as the channel is being inclined and in synchronism with such inclination to compensate for an otherwise lowering of the outlet end of the casting nose in consequence of inclining the channel, wherein the mounting means comprises an intermediate frame (29) pivotally mounted to the carriage by a pair of horizontal journals (30), and height adjustment means (34) disposed between the carriage and an end of said intermediate frame remote from the pair of journals, said upstream horizontal journal (27) being provided at an opposite end of the intermediate frame proximate said pair of journals.

2. The apparatus of claim 1, wherein the intermediate frame (29) includes a pair of horizontal cranks comprising said journal and said pair of journals, and a pair of side plates (28) integral with the frame and connecting said journal with said pair of journals, said pair of journals (30) being individually pivoted to the carriage and said journals (27) being located above said pair of journals (30).

3. The apparatus of claim 1, wherein said fluid cylinder means comprises a pair of matched cylinders (24) provided with rods having contoured ends, and two concave, spherical support plates (32) resting on the intermediate frame (29) and supporting said rod ends.

4. The apparatus of claim 1, wherein the intermediate frame (29) includes side plates (28) for defining a pair of bent levers, and the pair of journals (30) are located at crank elbows of the two bent levers.

5. The apparatus of claim 1, wherein the height adjustment means (34) comprises a pair of screw jacks equipped with control wheels (36), and a pair of support plates (35) having concave spherical surfaces supporting the jacks.

6. The apparatus of claim 5, comprising a further jack (38) disposed between the intermediate frame and the carriage to lift the frame while the screw jacks are being adjusted.

7. The apparatus of claim 1, further comprising hydraulic control means for extending the fluid cylinder (19) and the fluid cylinder means (24) in synchronism.

* * * * *